US006659550B2

(12) United States Patent
Hackett

(10) Patent No.: US 6,659,550 B2
(45) Date of Patent: Dec. 9, 2003

(54) UPHOLSTERY SYSTEM

(76) Inventor: Ruth H. Hackett, Clever systems, LLC, 208-16 Shearwater Ct., Jersey City, NJ (US) 07305

( * ) Notice: Subject to any disclaimer, the term of this patent is extended or adjusted under 35 U.S.C. 154(b) by 0 days.

(21) Appl. No.: 10/233,600

(22) Filed: Sep. 4, 2002

(65) Prior Publication Data

US 2003/0042774 A1 Mar. 6, 2003

Related U.S. Application Data

(60) Provisional application No. 60/316,871, filed on Sep. 4, 2001.

(51) Int. Cl.[7] ..... A47C 31/00

(52) U.S. Cl. ..... 297/228; 297/225; 297/228.13; 5/500

(58) Field of Search ..... 297/223, 224, 297/227, 228, 228.1, 228.11, 228.12, 228.13, 225; 5/482, 485, 494, 497, 500; 2/247, 209.11, DIG. 2

(56) References Cited

U.S. PATENT DOCUMENTS

| | | | | | |
|---|---|---|---|---|---|
| 2,083,236 | A | | 6/1937 | Levi | |
| 2,363,271 | A | | 11/1944 | Sugarman | |
| 2,459,328 | A | * | 1/1949 | Lenz | 297/228 |
| RE24,279 | E | * | 2/1957 | Schutte et al. | 297/227 |
| 2,818,106 | A | | 12/1957 | Reavis et al. | |
| 2,884,993 | A | | 5/1959 | Schutte | |
| 2,895,542 | A | | 7/1959 | Schutte | |
| 2,937,695 | A | * | 5/1960 | Coggin | 297/227 |
| 3,195,950 | A | * | 7/1965 | Mednick | 297/227 |
| 3,695,691 | A | * | 10/1972 | Putnam | 297/223 |
| 4,396,227 | A | * | 8/1983 | Neilson | 297/228.11 |
| 4,693,511 | A | * | 9/1987 | Seltzer et al. | 297/228.1 |
| 4,838,610 | A | * | 6/1989 | Perrin | 297/225 |
| 5,549,355 | A | | 8/1996 | Illulian | |
| 5,632,068 | A | * | 5/1997 | Riley et al. | 24/326 |
| 5,664,831 | A | * | 9/1997 | White et al. | 297/225 |
| 5,733,002 | A | | 3/1998 | Riley et al. | |
| 5,797,651 | A | * | 8/1998 | Christa | 297/283.1 |
| 6,398,301 | B1 | | 6/2002 | Illulian | |
| 6,427,265 | B1 | * | 8/2002 | Dix | 5/482 |
| 6,485,099 | B2 | * | 11/2002 | Illulian | 297/228.12 |

FOREIGN PATENT DOCUMENTS

| | | | | |
|---|---|---|---|---|
| FR | 2685860 A1 | * | 7/1993 | A47C/31/10 |
| GB | 521124 | | 5/1940 | |

* cited by examiner

*Primary Examiner*—Peter R. Brown
*Assistant Examiner*—Stephen D'Adamo
(74) *Attorney, Agent, or Firm*—Richard C. Litman

(57) ABSTRACT

A unique system of form-fitting, reversible, partial slipcovers adapted to fit numerous upholstered chairs, two-seat sofas and three-seat sofas. The slipcovers are designed and manufactured to be easily installed, reversed and removed for cleaning. A set of slipcovers for any of the above pieces of furniture consists of a pair of arm covers, one to three seat cushion covers and one to three back cushion covers. All the slipcovers employ a dual-fabric construction allowing the slipcovers to be quickly and easily reversed for a multitude of decor changes.

12 Claims, 4 Drawing Sheets

UPHOLSTERY SYSTEM

CROSS-REFERENCE TO RELATED APPLICATION

This application claims the benefit of U.S. Provisional Patent Application Serial No. 60/316,871, filed Sep. 4, 2001.

BACKGROUND OF THE INVENTION

1. Field of the Invention

The present invention generally relates to furniture accessories. More specifically, the present invention is drawn to a unique system of form-fitting, reversible, partial coverings for specified furniture pieces.

2. Description of the Related Art

Many attempts have been made to fabricate form-fitting, versatile, attractive slipcovers which are easy to install, easy to remove for cleaning and which would not betray the lines of the supporting furniture. The prior art however has failed in varying degrees to produce such slipcovers.

For example, U.S. Pat. Nos. 2,083,236 (Levi), 2,363,271 (Sugarman), 2,818,106 (Reavis), 2,884,993 (Schutte), 5,733,002 (Riley et al.) and British Patent 521,124 (Barker) all show slipcovers that are cumbersome and relatively complicated to install and remove. Further, the slipcovers of the instant patents are not versatile in that they cannot be reversed to give a different "look".

U.S. Pat. No. 2,895,542 (Schutte) shows a cover for a cushion. As in the patents listed above, no attempt is made to provide for versatility in the cover.

U.S. Pat. No. 5,549,355 (Illulian) is drawn to a slipcover which utilizes an elastic band to secure the cover to the furniture. Besides lacking versatility, the slipcover appears to be bulky and obscures the lines of the furniture.

U.S. Pat. No. 6,398,301 B1 (Illulian) discloses a reversible slipcover secured to the furniture with a system of unsightly cords. The slip cover does not appear to provide a smooth, aesthetically pleasing fit.

None of the above inventions and patents, taken either singularly or in combination, is seen to disclose reversible, easy to install and remove, form-fitting slipcovers as will subsequently be described and claimed in the instant invention.

SUMMARY OF THE INVENTION

The slipcovers of the present invention, to be dubbed Slip-Polstery, are a unique system of form-fitting, reversible, partial coverings adapted to fit numerous upholstered chairs, two-seat sofas and three-seat sofas. The slipcovers are designed and manufactured to be easily installed, reversed and removed for cleaning. A set of slipcovers for any of the above pieces of furniture consists of a pair of arm covers, one to three seat cushion covers and one to three back cushion covers.

The arm covers are constructed in a manner to allow a user to custom-fit the cover to the specific dimensions of the arm of the furniture. The seat cushion slipcovers include a flap which may optionally function as a modified skirt. All the slipcovers employ a dual-fabric construction allowing the slipcovers to be quickly and easily reversed for a multitude of decor changes.

Accordingly, it is a principal object of the invention to provide a system of slipcovers, which system can be easily installed and removed.

It is another object of the invention to provide a system of slipcovers, which system is reversible.

It is a further object of the invention to provide a system of slipcovers, which system is adapted to fit numerous upholstered chairs, two-seat sofas and three seat sofas.

Still another object of the invention is to provide a system of slipcovers, which system utilizes dual-fabric construction.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
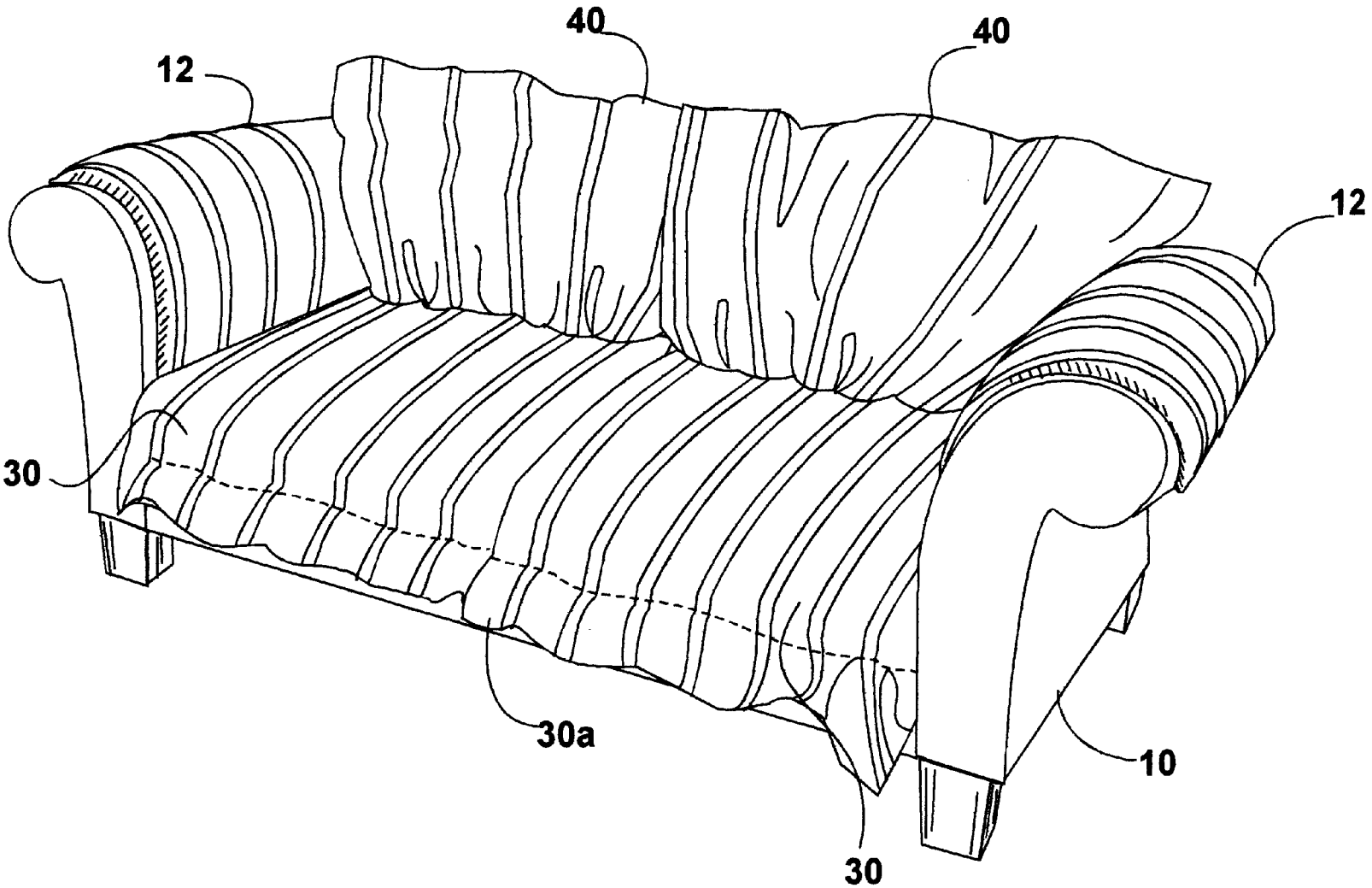
FIG. 1 is an environmental, perspective view of a upholstery system according to the present invention.
Figure 2:
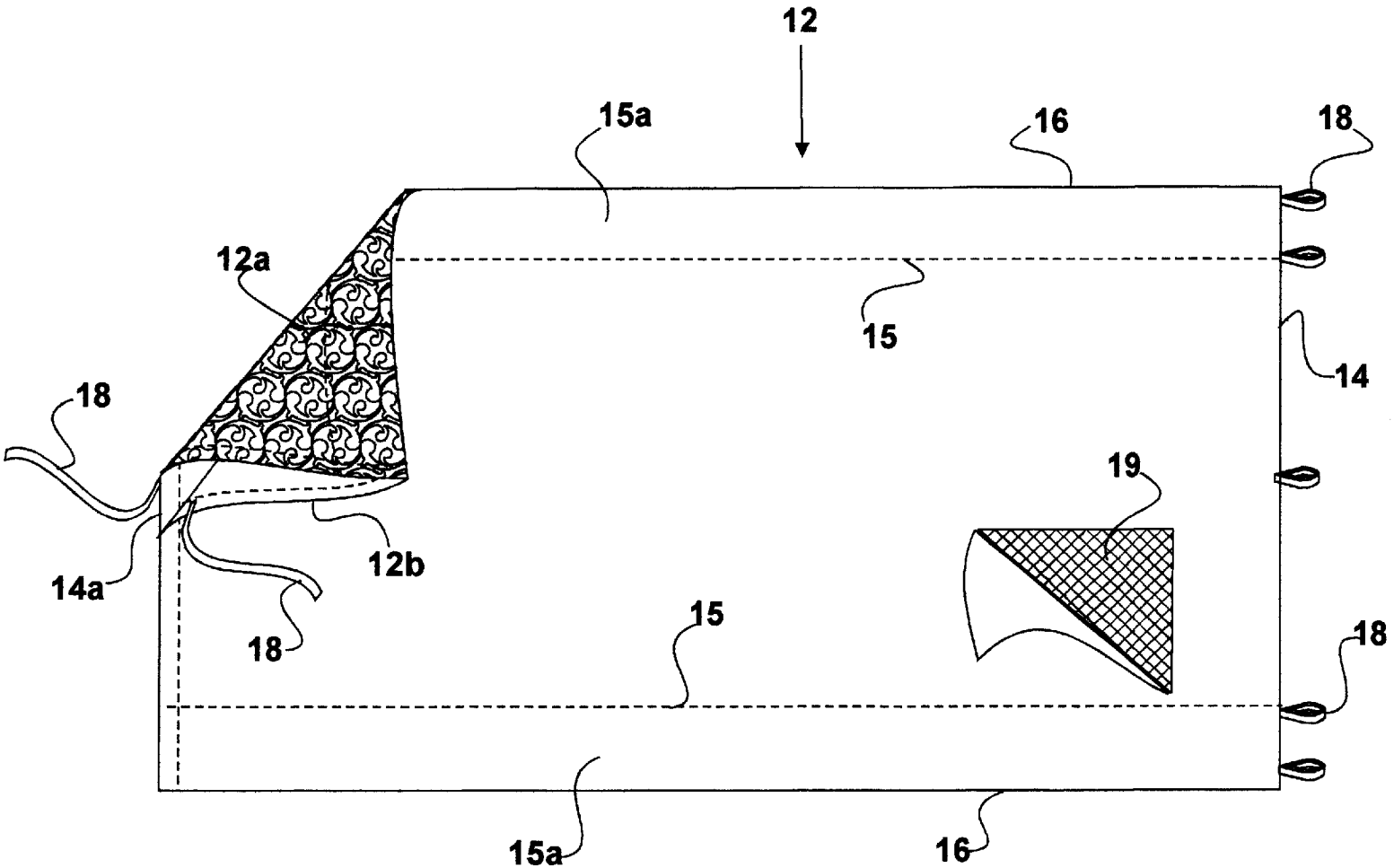
FIG. 2 is a partially cut-away, plan view of an arm slipcover according to the present invention.

Attention is first directed to FIG. 1 which illustrates the slipcovers of the present invention disposed on a two-seat sofa 10. The slipcovers consists of arm covers 12, seat cushion covers 30 and back cushion covers 40. As best illustrated in FIG. 2, the arm cover comprises a rectangular structure fabricated from two different types of fabric 12*a* and 12*b*. The two types of fabric may have different patterns or designs on their exposed faces. The pieces of fabric may be of any type suitable for a chair or sofa. For example, 12*a* may be a twilled fabric and 12*b* may be a faux leather fabric. For optimum use, it has been determined that each piece should be approximately thirty-four inches wide and forty-eight inches long. To make the cover, the two pieces are placed atop one another "right -side" in, "wrong-side" out. Prior to stitching, five one-fourth inch elastic loops 18 are attached to either of the pieces along the short side 14. Two of the five loops are each positioned adjacent a respective long side 16. Another two of the five loops are each positioned approximately four inches from a respective long side 16. The fifth loop is positioned at approximately the half way point between the long sides. The two pieces of fabric are then stitched together (approximately one-fourth inch from the outer edge) along one short side 14 and along each long side 16. One short side 14*a* is left open so that the stitched pieces form a bag-like structure. The cover is then turned inside out exposing the "right sides" of the two fabrics as illustrated in FIG. 2. Two cloth ties 18 are attached at respective opposed center points on open side 14*a*. The arm cover is then top-stitched at 15 approximately four inches from the edge along the entire length of each long side 16. This creates a reversible-fabric arm cover with an approximate twenty-six inch opening at one end and two four inch by forty-eight inch flaps 15*a* on each side. A muslin-covered, one-half inch thick, foam rubber member 19 is disposed in and substantially fills the arm cover and is closed therein by ties 18.

Figure 4:
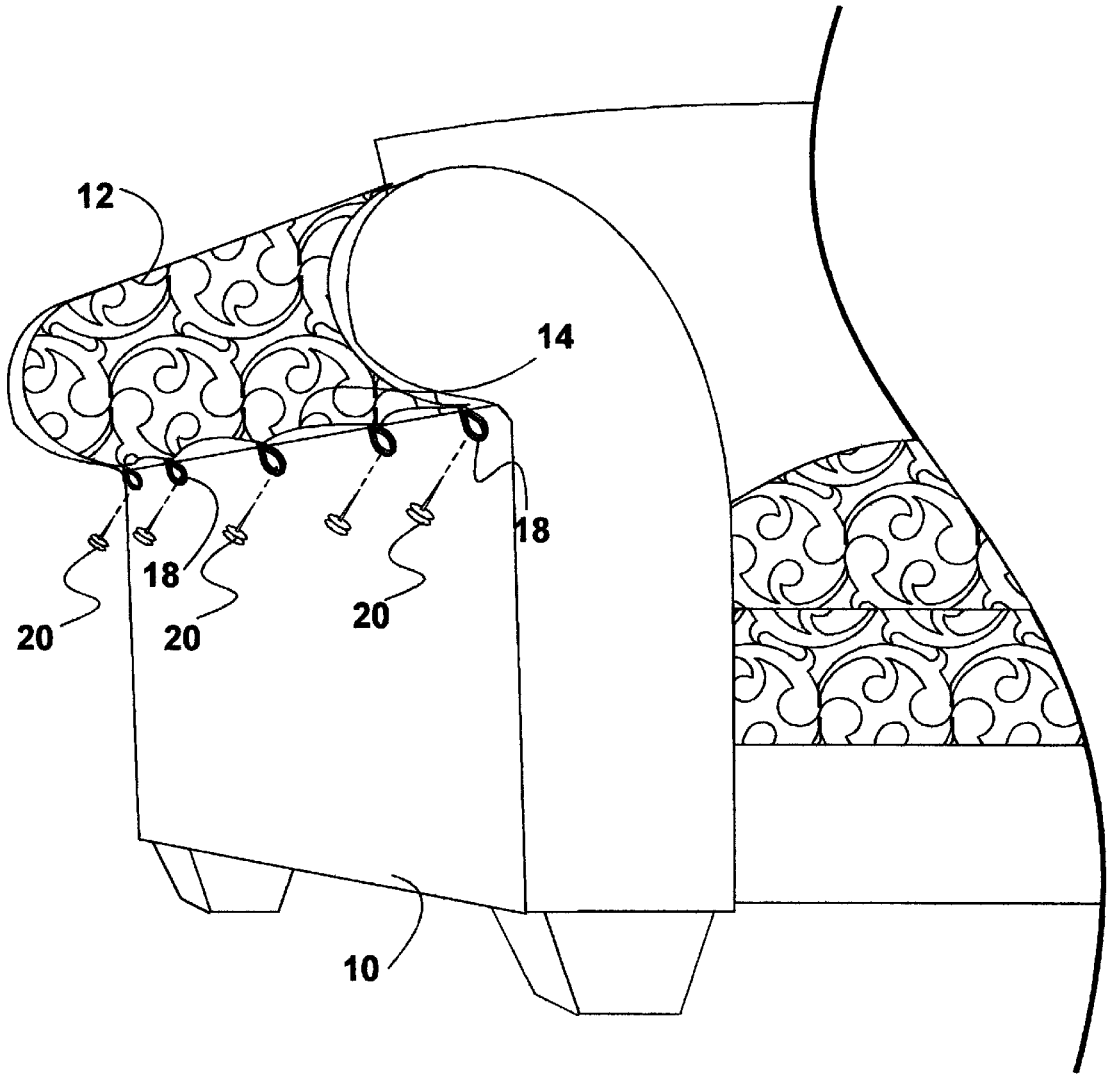
FIG. 4 is a partial, perspective view of the arm slipcover being attached to the arm of the furniture according to the present invention.

The arm cover is installed by positioning the cover on the arm of the sofa or chair desired fabric side up. The cover size may be adjusted by folding in or leaving extended the flaps 15*a*. The end of the cover having the loops is affixed to the sofa or chair arm by employing twist pins 20 as shown in FIG. 4. The other end of the arm cover is tucked between the seat and the arm of the chair or sofa.

Figure 3B:
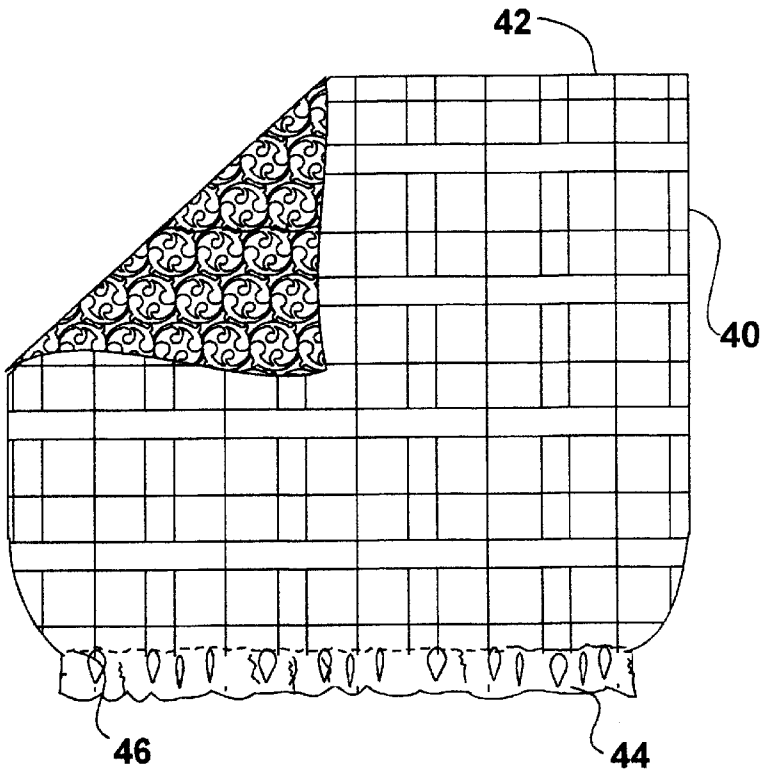
FIG. 3*b* is a plan view of a back cushion slipcover according to the present invention.
Figure 3A:
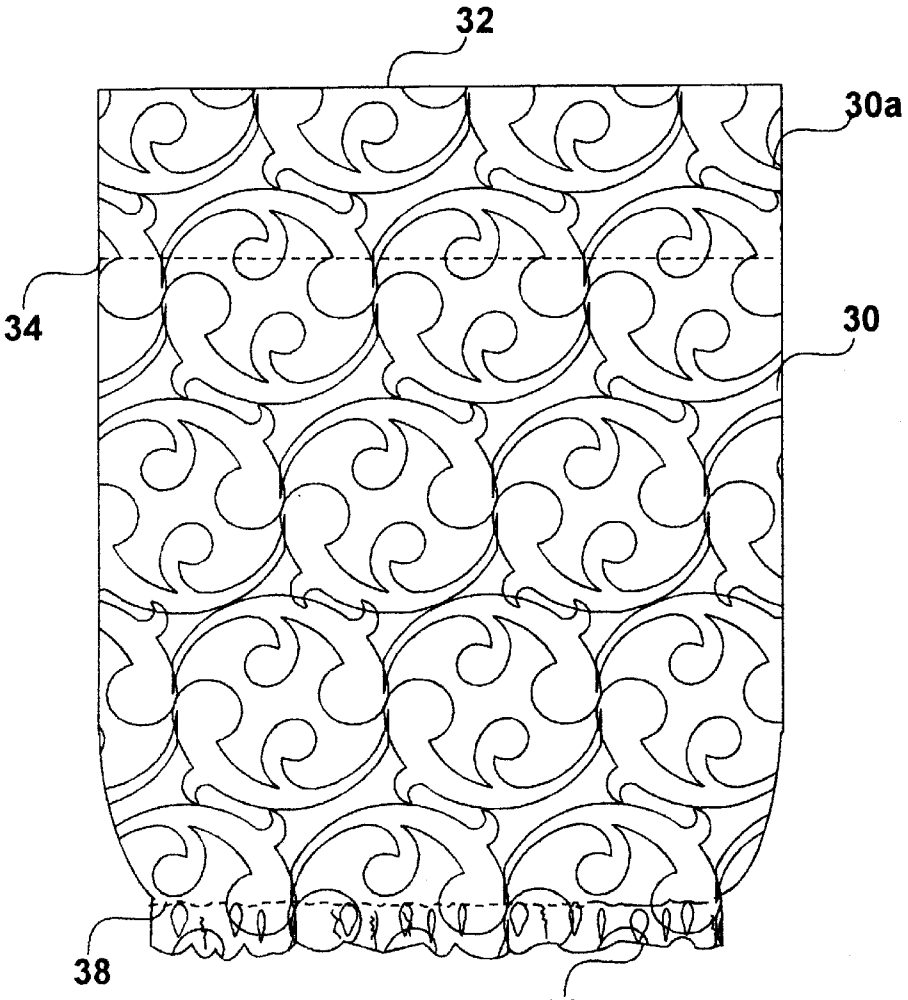
FIG. 3*a* is a plan view of a seat cushion slipcover according to the present invention.

FIGS. 3*a* and 3*b* illustrate a seat cushion slipcover 30 and back cushion slipcover 40. Both cushion covers employ the different fabric arrangement as described above. The covers differ as to size in that the seat cover 30 is approximately 30 inches by forty-three inches and includes a closed side 32 and a horizontal top-stitch 34 disposed ten inches from closed side 32 so as to create a ten inch by thirty inch flap 30*a*. Flap 30*a* may hang down from the cushion to form a modified skirt (FIG. 1) or it may be tucked underneath the cushion, eliminating the flap from sight. Open side 36 is circumvented by an elastic cord 38 hemmed therein. The elastic cord is of a length to insure a snug fit when a seat cushion inserted in the cover 30. The back cushion cover 40 is approximately thirty inches by twenty-four inches and includes a closed side 42 and an open side 44. Back cushion 40 also incorporates a suitable length of elastic cord 46 hemmed into open side 44.

It is to be understood that the present invention is not limited to the embodiment described above, but encompasses any and all embodiments within the scope of the following claims.

I claim:

1. An upholstery system comprising:

at least two arm slipcover members;

at least one seat cushion slipcover member;

at least one back cushion slipcover member;

each of said two arm slipcover members is a rectangularly-configured, bag-like structure having a first side, a second side, a closed end and an open end, and has a first face constructed from a first fabric and a second face constructed from a second fabric, wherein said first fabric and said second fabric are of different types; and a plurality of loop members attached to the closed end of said bag-like structure, wherein:

a first of said plurality of loop members is attached to said closed end adjacent of a structure adjacent said first side;

a second of said plurality of loop members is attached to said closed end adjacent said second side;

a third of said plurality of loop members is attached to said closed end a distance of approximately four inches from said first side;

a fourth of said plurality of loop members is attached to said closed end a distance of approximately four inches from said second side; and a fifth of said plurality of loop members is attached to said closed end at a distance halfway between said first side and said second side.

2. An upholstery system as recited in claim 1, including a first flap member defined on said first side of said bag-like structure and a second flap member defined on said second side of said bag-like structure.

3. An upholstery system as recited in claim 2, wherein each said first flap member and said second flap member has a length of approximately forty-eight inches and a width of approximately four inches.

4. An upholstery system as recited in claim 3 including, a muslin covered foam rubber member, said foam rubber member disposed in said bag-like structure.

5. An upholstery system as recited in claim 4, wherein said at least one seat cushion slipcover member has a first exposed face constructed from said first fabric and a second exposed face constructed from said second fabric.

6. An upholstery system as recited in claim 5, wherein said at least one back cushion slipcover member has a first exposed face constructed from said first fabric and a second exposed face constructed from said second fabric.

7. An upholstery system as recited in claim 6, wherein said at least one seat cushion slipcover member is a bag-like structure having a closed end and an open end;

a hem defining said open end of said seat cushion slipcover member; and an elastic cord disposed in said hem.

8. An upholstery system as recited in claim 7, including a third flap member defined on said closed end of said seat cushion slipcover member, said third flap member having a length of approximately thirty inches and a width of approximately ten inches.

9. An upholstery system as recited in claim 8, wherein said at least one back cushion slipcover member is a bag-like structure having a closed end and an open end;

a hem defining said open end of said back cushion slipcover member; and an elastic cord disposed in said hem of said back cushion slipcover member.

10. An upholstery system as recited in claim 9, including a pair of ties attached at each open end of said arm slip cover members.

11. An upholstery system as recited in claim 10 wherein there are two seat cushion slipcover members and two back cushion slipcover members.

12. An upholstery system as recited in claim 10 wherein there are three seat cushion slipcover members and three back cushion slipcover members.

* * * * *